US007416521B2

(12) United States Patent
Forman et al.

(10) Patent No.: US 7,416,521 B2
(45) Date of Patent: Aug. 26, 2008

(54) EASY-OPEN PACKAGES

(76) Inventors: Harold M. Forman, 200 N. Washington St., Pennsburg, PA (US) 19512; Trevor G. Smith, 152 Gay St., Phoenixville, PA (US) 19460; Alfred E. Kettell, 161 Erie Ave., Souderton, PA (US) 18964

( * ) Notice: Subject to any disclaimer, the term of this patent is extended or adjusted under 35 U.S.C. 154(b) by 0 days.

(21) Appl. No.: 11/594,791

(22) Filed: Nov. 9, 2006

(65) Prior Publication Data

US 2007/0062838 A1 Mar. 22, 2007

Related U.S. Application Data

(60) Division of application No. 10/937,264, filed on Sep. 10, 2004, now Pat. No. 7,216,764, which is a continuation-in-part of application No. 10/918,389, filed on Aug. 16, 2004, now abandoned.

(51) Int. Cl.
*B31B 1/90* (2006.01)

(52) U.S. Cl. ..... 493/377; 493/378; 53/412; 53/133.6; 53/133.8

(58) Field of Classification Search ..... 53/412, 53/133.6, 133.7, 133.8; 493/377, 378
See application file for complete search history.

(56) References Cited

U.S. PATENT DOCUMENTS 4,610,357 A 9/1986 Nakamura
4,653,250 A * 3/1987 Nakamura ..... 53/412
4,709,399 A * 11/1987 Sanders ..... 383/66
5,048,718 A * 9/1991 Nakamura ..... 221/35
5,161,350 A * 11/1992 Nakamura ..... 53/412
6,026,953 A * 2/2000 Nakamura et al. ..... 206/233
6,047,882 A * 4/2000 Sin et al. ..... 229/125.32
6,254,519 B1 * 7/2001 Toshima ..... 493/214
6,865,860 B2 * 3/2005 Arakawa et al. ..... 53/412
6,889,483 B2 * 5/2005 Compton et al. ..... 53/412
7,302,783 B2 * 12/2007 Cotert ..... 53/412

* cited by examiner

*Primary Examiner*—Hemant M Desai
(74) *Attorney, Agent, or Firm*—Gregory J. Gore

(57) ABSTRACT

An apparatus and method for making a composite packaging material for easy-open packages includes means for pulling a running length of packaging film, the film having defined rupture characteristics. The packaging film is perforated with a sequence of spaced apart at least one perforation separated from another at a substantially constant fixed interval between adjacent ones of the sequence along the length of the film. A tape with a continuously extending dry edge is formed from a continuous supply of tape and tape pieces are formed and spaced apart along the length of the film. Successive discrete pieces of tape are adhered to the packaging film in overlying sealing relationship to successive ones of the sequence of at least one perforation.

16 Claims, 12 Drawing Sheets

FIG.3
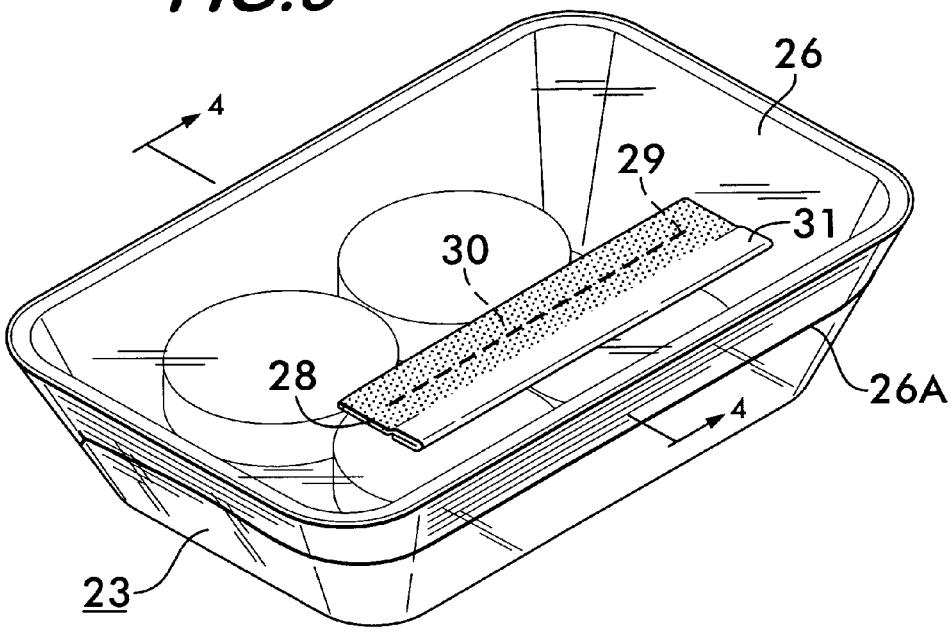
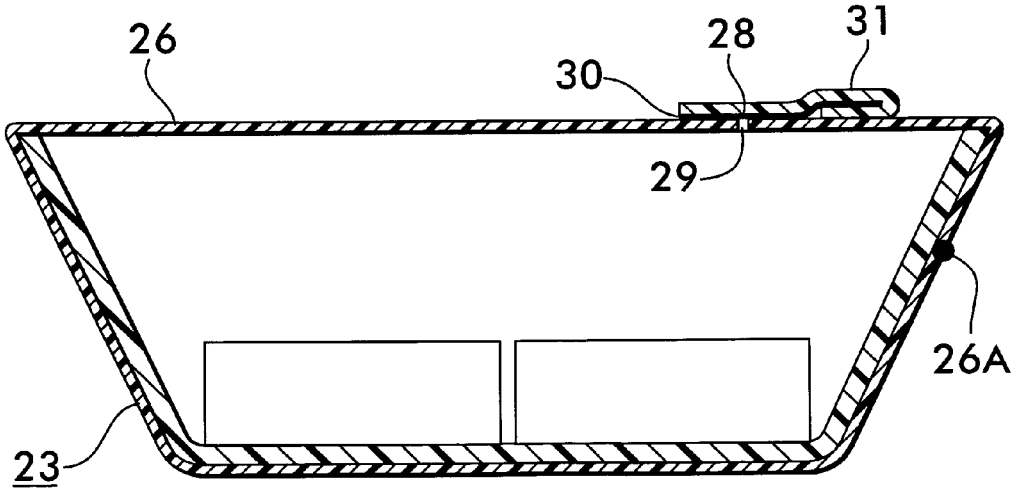
FIG.4

FIG.8A
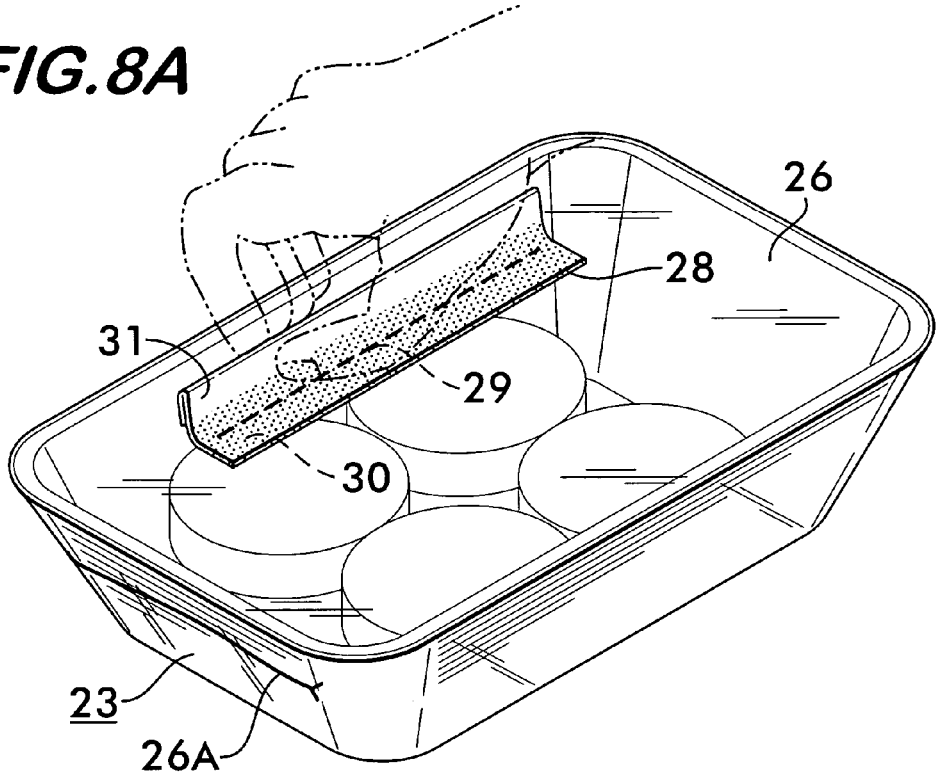
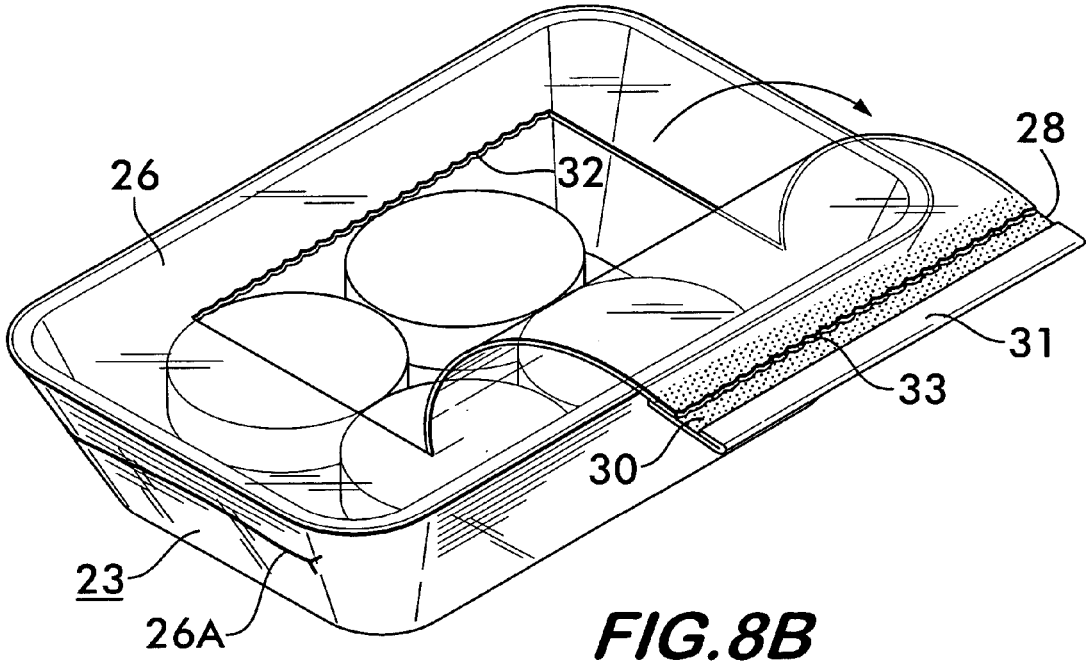
FIG.8B

FIG.9
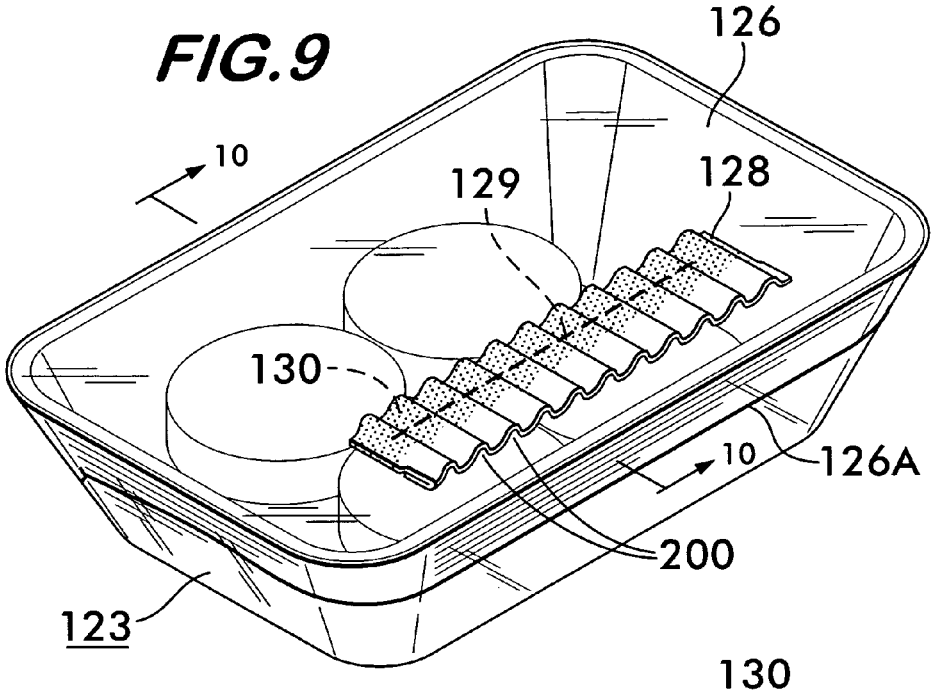
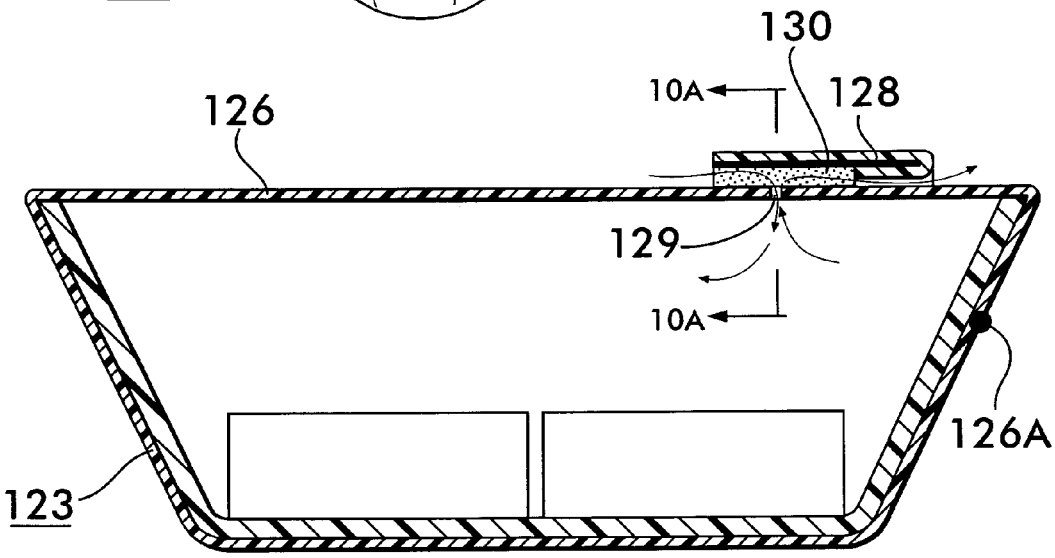
FIG.10
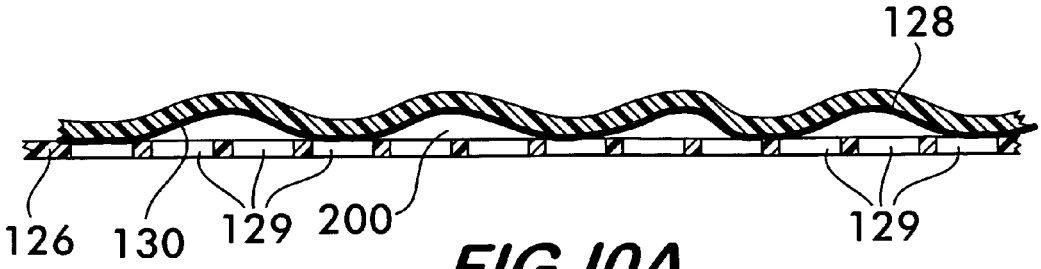
FIG.10A $t_3 - t_2 \approx 5\%\ t_2 - t_0$

EASY-OPEN PACKAGES

This application is a divisional of patent application Ser. No. 10/937,264 filed Sep. 10, 2004 now U.S. Pat. No. 7,216,764, issued on May 15, 2007, for "Easy-Open Packages," which is a continuation-in-part of prior application Ser. No. 10/918,389 filed Aug. 16, 2004 now abandoned for "Easy-Open Packages," priority from which is hereby claimed. The invention relates to packages, and more particularly to easily openable packages, which in one application are air and moisture resistant shrink film wrapped for extending the shelf life of products adversely affected by bacterial action and oxidation. The invention is also useful for other products where ease of package opening is desirable.

BACKGROUND OF THE INVENTION

Conventionally, many products are packaged in plastic wrappers, some in shrink film. In the past, such wrappers have not been air and moisture proof, and during packaging, storage and display, over time, air and moisture can penetrate the wrapper and contact the product within, causing spoilage of spoilable products such as meat, fish and poultry due to oxidation and bacterial action. In some cases, such as packaging fresh meat, the package may be oxygen flushed to preserve color, and in other cases flushed with other gases such as nitrogen.

Such wrappers, however, despite being permeable, are physically strong and tough, and are time consuming to open, often requiring the use of cutting implements. Accordingly, two problems have existed with regard to such packages, first, the use of non-spoilage retarding air and moisture permeable wrapping materials, and second, consumer inconvenience because of the difficulty of opening such packages.

The first problem has been effectively solved by a new, non-permeable, shrink film, made by Sealed Air Inc. and marketed as Cryovac BDF film. Unfortunately, this improved film is even stronger and tougher than the previously used films, and has materially worsened the already bad package opening problem. Prior attempts to solve the opening problem for packages wrapped in this new film, as well as for the previously existing wrapper films, have not been successful, because such attempts have not been able to maintain the non-permeability barrier, thus negating the value of these packaging films.

SUMMARY OF THE INVENTION

One form of novel package wrapper according to the invention for use in packaging spoilable food products is made of a non-permeable food quality plastic shrink film, such as Cryovac BDF, utilizing a non-permeable tear-down tape sealed to one face of the package in overlying relation to a row of perforations in the wrapper film, thereby maintaining the non-permeability of the package wrapper. The wrapper perforations do not extend the full length of the package, and can be a row of slits ranging in size from 20 mils to 500 mils in length, and being spaced apart between 10 mils and 50 mils, and typically might be 125 mil slits spaced apart by 15 mils. The teardown tape extends beyond each end of the row of perforations a sufficient distance to insure non-exposure of the end slits, which may be by about ½", but the tape ends stop short of the package ends to avoid being sealed into the package end seals, which would lock the tape ends and prevent the package opening teardown action. For effective package opening purposes the tape can extend substantially less than the package length, thereby using a relatively small amount of tape and reducing tape costs. The package is completely sealed but does not require the use of any tool to open it, the teardown tape providing the package opening function.

In this application the teardown tape is not made of shrink film because the application of a suitable adhesive to a shrink film tape requires heat curing to evaporate the adhesive solvent and render the tape usable. Unless the heat curing is done very slowly, which substantially increases the cost of tape production, the heating process would cause the tape to shrink, becoming a non-shrink tape, and rendering it unusable for its intended purpose, since it would pucker when the underlying shrink film were shrunk, disclosing the package wrapper perforations and unsealing the package.

The teardown tape according to the invention for use in shrink film packaging is made of non-permeable ordinarily non-shrinkable plastic film, such as polypropylene, which is stretched on the packaging line just prior to application to the wrapper film to convert it into a shrinkable tape, and is provided with a dry edge for grasping to subsequently carry out the teardown function. The degree of stretch is calibrated to produce a tape having the same shrink characteristics as the wrapper film to which it is applied, so that the tape and film shrink together in the packaging machine heat tunnel with no puckering of the wrapper film at the perforation line. The tape can not be previously stretched and stored, because cold stretched tapes are perishable, in that somewhat after stretching tension is released they begin to contract. In non-shrink film applications the teardown tape is not stretched before application to the wrapper film.

In all applications, the attachment of the teardown tape to the wrapper film by the tape adhesive must be weak enough to allow the tape to be peeled off of the intact wrapper film without rupturing the unbroken film, but strong enough to hold to the wrapper film below the perforation line, rupturing the film through the perforations, and allowing teardown of the wrapper film. It is also required in food packaging applications that the adhesive not crystallize in a freezer, which would cause the tape to fall off of the package, and must be capable of being applied in cold and humid conditions. Rubber based and acrylic based adhesives satisfy these conditions.

The teardown package opening invention may also be utilized with non-shrink films for other packaging applications. In such cases, the teardown tape is not stretched, but is similarly applied to the film directly over the film perforations to effect package opening in the previously described way by grasping the tape dry edge and pulling it down across the perforations.

It is a primary object of the invention to provide a novel, easily openable and removable package wrapping.

It is another object of the invention to provide a novel, easily openable and removable package wrapping as aforesaid which utilizes a non-permeable shrink film wrapper film and a non-permeable teardown tape overlying and sealing a row of perforations in the wrapper.

It is an additional object of the invention to provide a novel package wrapping as aforesaid, which utilizes a non-permeable teardown tape structure completely overlying a row of perforations in the wrapper, wherein both the row of perforations and the tape length are shorter in extent than the length of the package face on which they are positioned, and the tape ends are not bound into any of the package seals.

It is a further object of the invention to provide a novel package wrapping as aforesaid that may be removed without causing injury to the package contents during package opening.

It is a still further object of the invention to provide novel methods of making the wrapped packages according to the invention as aforesaid.

It is yet another object of the invention to provide novel apparatus for making the wrapped packages according to the invention as aforesaid.

The foregoing and other objects of the invention will appear more fully hereinafter as disclosed by the following description and accompanying drawings, wherein:

DESCRIPTION OF THE DRAWINGS

FIG. 3 is an isometric view taken from above of a novel package made according to the invention;

FIG. 4 is a vertical cross section through the package of FIG. 3 as would be seen when viewed along the lines 4-4 on FIG. 3;

FIG. 8A is similar to FIG. 3 but shows the start of the package opening process for the package of FIG. 3 by lifting and grasping of the dry edge of the package opener;

FIG. 8B is an isometric view of the package of FIGS. 3 and 8A illustrating the package in a partially opened condition;

FIG. 9 is an isometric view taken from above of a shrink wrapped package illustrating the problem resulting from use of a non-shrink tape with a shrink film wrapper, rendering the package unsealed along the perforation line;

FIG. 10 is a vertical cross section through the package of FIG. 9 as would be seen when viewed along the lines 10-10 on FIG. 9;

FIG. 10A is a vertical cross section through the package of FIG. 9 as would be seen when viewed along the lines 10A-10A on FIG. 10;

In the several figures, like elements are denoted by like reference characters.

DETAILED DESCRIPTION

Figures 1, 2:
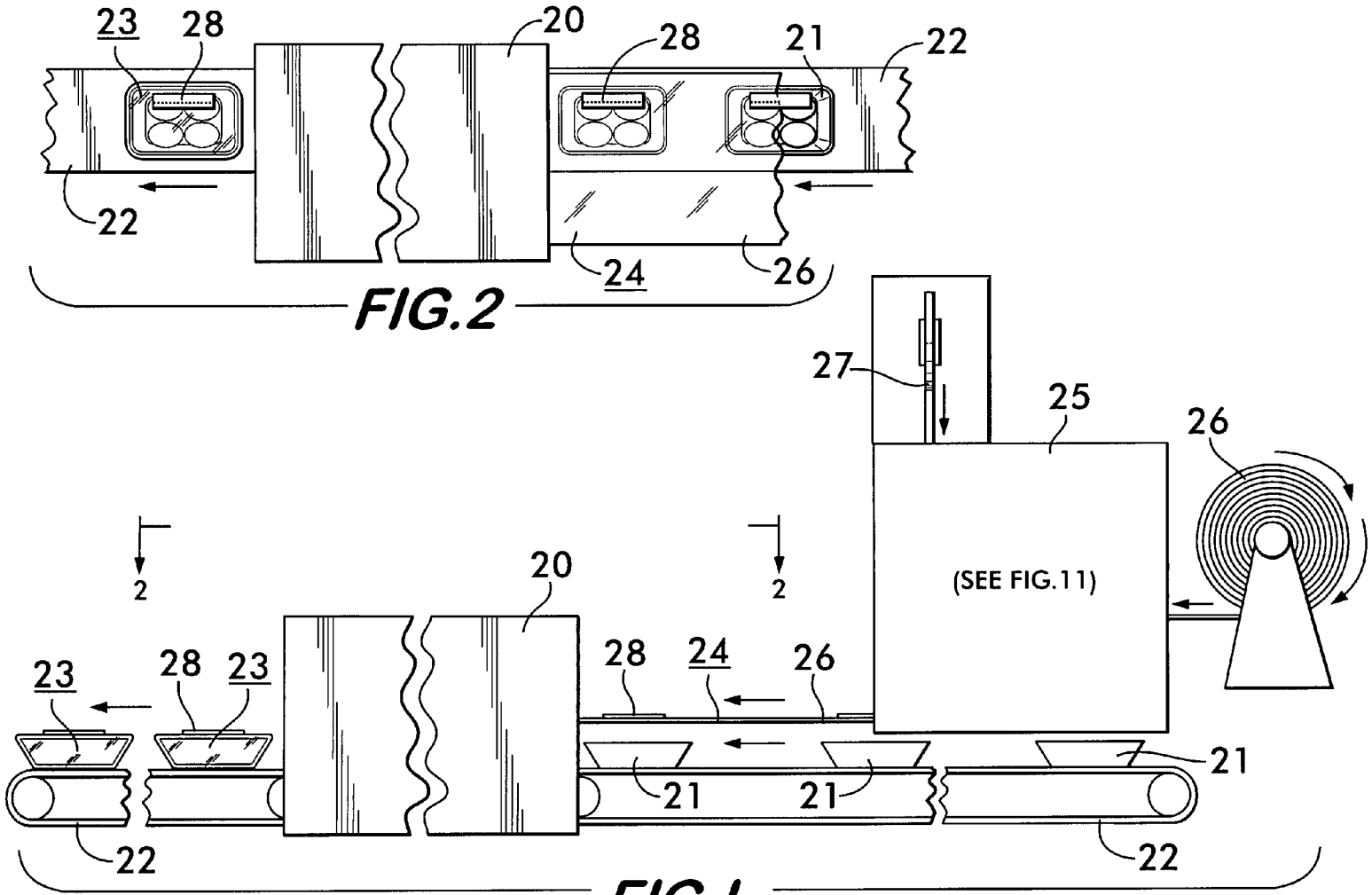
FIG. 1 illustrates in diagrammatic form, the novel packaging of products in a system incorporating the invention.
FIG. 2 illustrates a top plan view of the packaging operation as would be seen when viewed along the lines 2-2 on FIG. 1.

Considering first FIGS. 1 and 2, there is seen a horizontal packaging machine 20 into which flow a series of containers 21 holding a product to be packaged, the containers being moved into the packaging machine 20 on a conveyor 22, and emerging from the packager 20 as the finished wrapped packages 23. The packaging machine 20 could be, for example, a Linium Model 305 horizontal packaging machine made by Doboy Inc. The containers 21 are packaged in the composite wrapper film 24 shown disposed above the containers 21 and as emerging from the wrapper former 25 to be subsequently described in detail. The composite wrapper 24 is formed by the wrapper former 25 from the supply roll of packaging wrapper film 26 and precisely cut tape strip lengths 28 from the supply roll of wrapper film sealing tape 27.

As seen in FIG. 3, the wrapper film 26 is provided by the wrapper former 25 with a row of perforations 29 overlaid and sealed by the adhesive coated portion 30 of the tape strip 28, the end portions of the tape strip 28 extending beyond the ends of the row of perforations a sufficient distance to insure that the package is sealed. The wrapper perforations may be slits ranging from 20 mils to 500 mils in length spaced apart from 10 mils to 50 mils, and typically, in a food package wrapped in a tough film such as 1 mil thick Cryovac BDF non-permeable shrink film, might be slits of 125 mils in length spaced apart by 15 mils. Other permeable shrink firms may vary in thickness between 0.5 mils and 1.25 mils. The general rule to be followed is that, in a package containing a food product the slits are made sufficiently small that the tape adhesive does not contact the food product.

Figure 5:
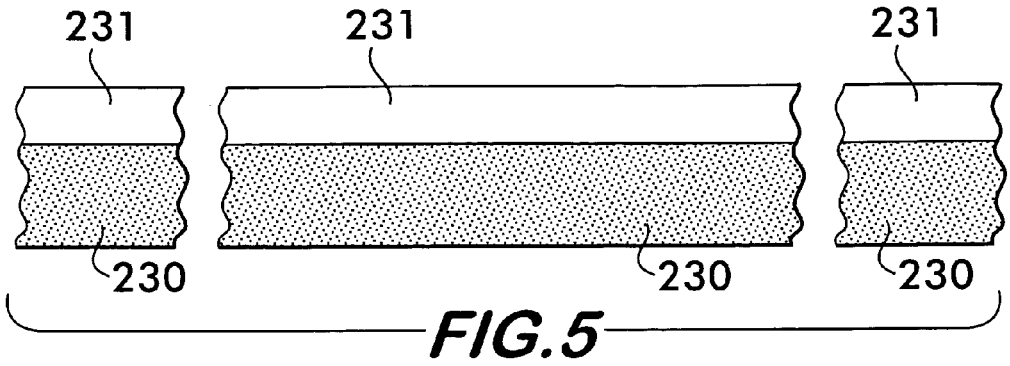
FIGS. 5 and 6 are plan views of alternative forms of package sealing tapes.
Figure 6:
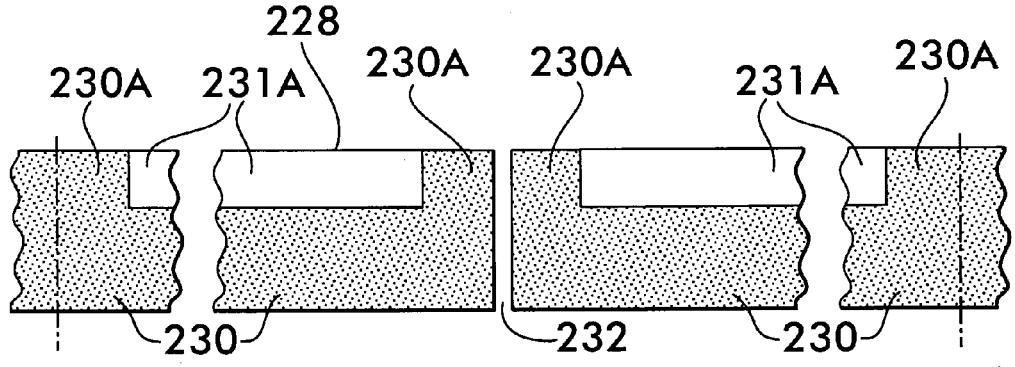
Figure 7:
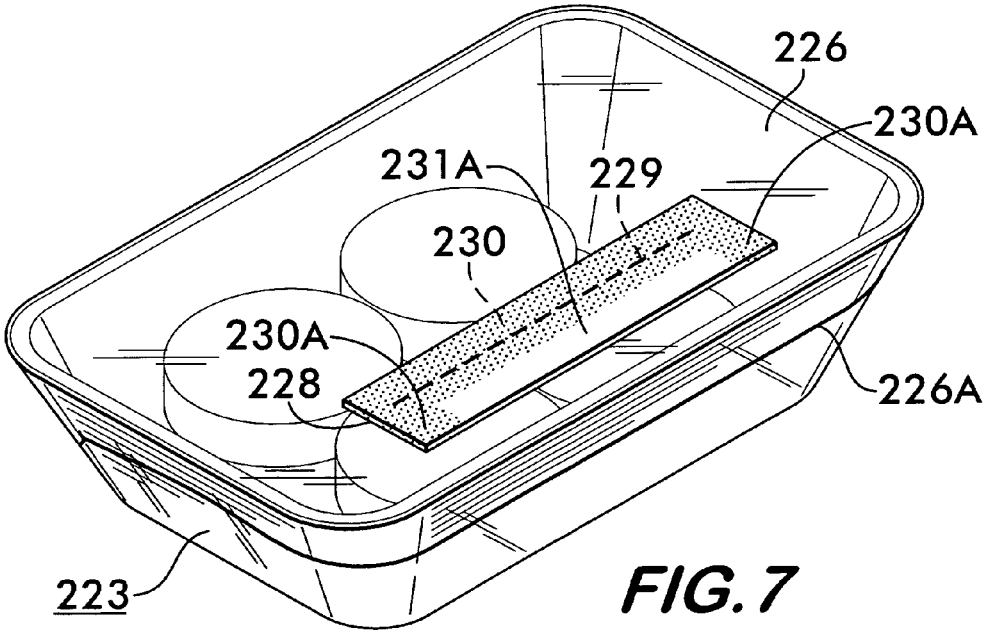
FIG. 7 is an isometric view similar to that of FIG. 3, but illustrating the use of the alternative forms of package sealing tapes shown in FIGS. 5 and 6.

The tape strip 28, which may preferably be made of 2 mils thick polypropylene or polyester about 1.25" wide, or alternatively of 3 mils thick PVC or polyethylene, is provided with an approximately ¼" wide dry edge 31 by the wrapper former 25, as seen in FIG. 3, by turning one edge of the tape back upon itself. As seen in FIGS. 5 and 6, the tape dry edge may be formed in other ways known in the art, as for example by deadening the marginal portions 231 and 231A of the tape adhesive coating 230 with a non-tacky substance such as ink. The marginal portions 231 and 231A can alternatively also be an overlying narrow strip of material adhered onto the marginal portion of the adhesive coated tape, or can be formed by zone coating the adhesive 230 onto the tape substrate to leave the areas 231 and 231A uncoated. In the alternative tape forms shown in FIG. 6, the adhesive coated marginal areas 230A provide tape ends hold downs, as shown in FIG. 7. These hold downs 230A prevent the tape ends from becoming caught by packages that may be stacked on one another and undesirably tear off a tape on an underlying package. The tape 228 is severed, as at 232, substantially centrally through the adhesive area 230A, to form the discrete pieces of tape adhered to successive packages.

To open the package 23, as seen in FIGS. 3, 8A and 8B, the tape dry wrapper film 26 until the perforation line 29 is passed, at which point the hold of the adhesive 30 to the wrapper film 26 below the perforation line 29 is strong enough to rupture the wrapper film through the perforation line and tear the film away from the package, as seen in FIG. 8B, the perforation line being split in two, as at 32 and 33. In general, the wrapper film 26 can be completely torn around the package to open it. Or, the now torn open package film can be pulled open in other directions as desired from any of the sides of the opening. As seen in FIGS. 3 and 4, prior to package opening, the perforation line 29 is completely sealed by the overlying tape 28.

Similarly, to open the package 223, as seen in FIG. 7, the tape dry edge 231A is grasped and pulled toward the line of perforations 229 against the hold of the adhesive 230. The tape 228 first peels from the wrapper film 226 at the end tacks 230A, and downward until the perforation line 229 is passed, at which point the hold of the adhesive 230 to the wrapper film 226 below the perforation line 229 is strong enough to rupture the wrapper film through the perforation line and tear the film away from the package, as previously seen in FIG. 8B.

It should be noted in FIG. 2 that the package trays 21 are offset asymmetrically with respect to the longitudinally extending side edges of the wrapper film 26, so that the resulting longitudinal package seal 26A shown in FIGS. 3, 4, 8A and 8B, and package seal 226A shown in FIG. 7 are positioned on the package side proximate to the tear down tape strip 28. The orientation of the tear down tape strip 28 is such that the dry edges 31 and 231A pull in a direction away from the package seals, as seen in FIGS. 8A and 8B, permitting the major part of the package wrapper to be torn open before encountering the longitudinal package seals 26A and 226A, which would prevent further wrapper tearing.

Considering now the package shown in FIGS. 9, 10 and 10A, FIG. 9 illustrates the problem resulting from use of a non-shrink tape 128 with a shrink film wrapper 126, rendering the package 123 unsealed along the perforation line 129, best seen in FIG. 10A. FIGS. 9 and 10A show how the tape 128 does not shrink with the wrapper film 126, creating the convoluted or rippled tape configuration resulting in tunnels 200 allowing the movement of air through the now open perforations 129. Accordingly, it is seen that this is an unsealed package, which is unacceptable. This problem has been solved by the package structure according to the invention.

Referring now to FIGS. 11 through 15, but first to FIGS. 11 to 14, there is seen the apparatus for making the composite package wrapper 24 consisting of the shrink film 26 and the discrete strips of stretched shrinkable sealing tape 28 adhered thereto at the proper locations to precisely overlie and close the perforation line 29 in the film 26. The form of dry edge tape shown is the turned edge form designated as 31 in FIG. 3, but is only shown as illustratively, any of the other described forms being equally suitable.

Figure 11:
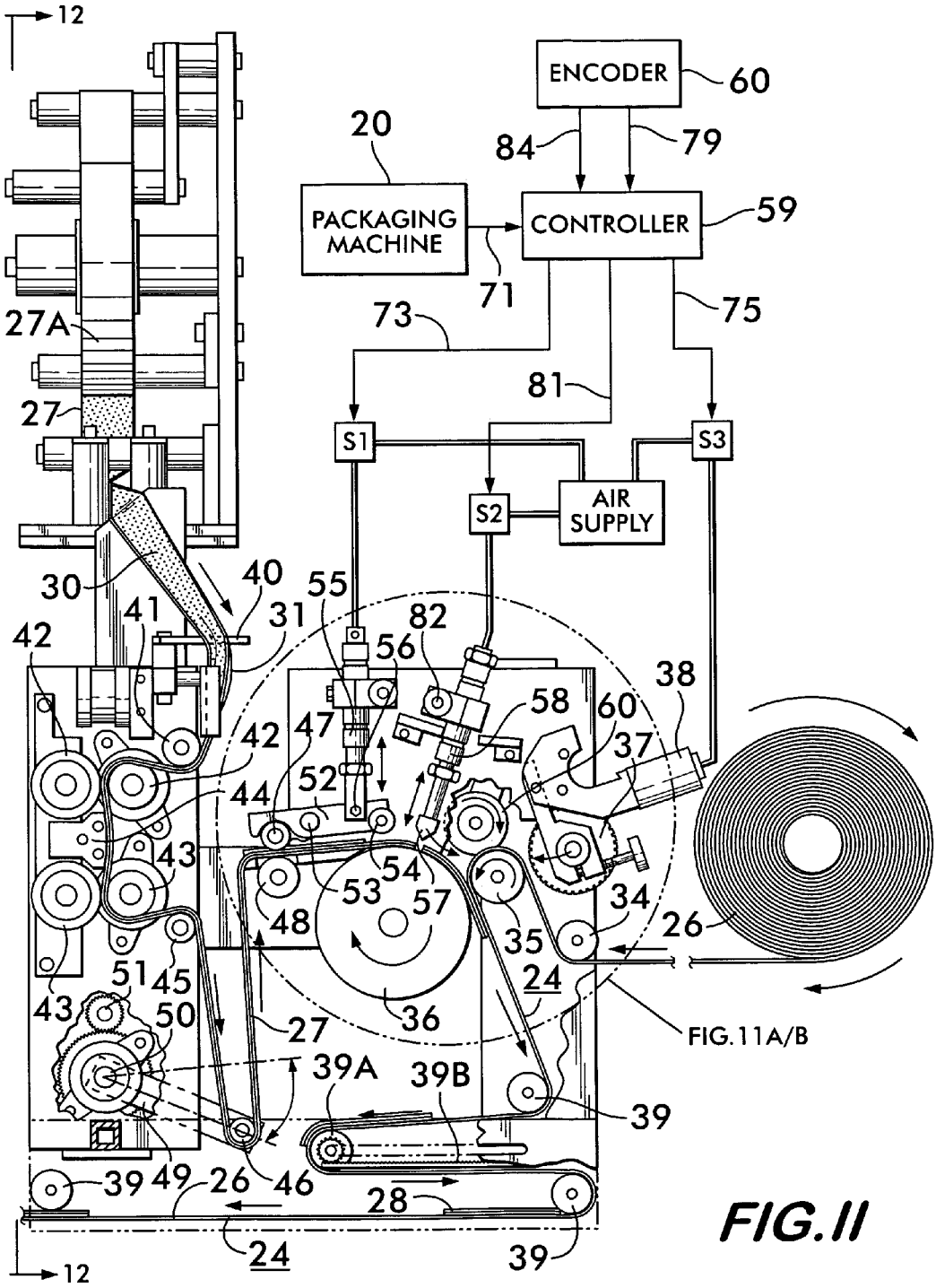
FIG. 11 is a front elevational view of the novel apparatus according to the invention for creating the novel composite openable package wrapper, with the apparatus shown before start-up.
Figure 14:
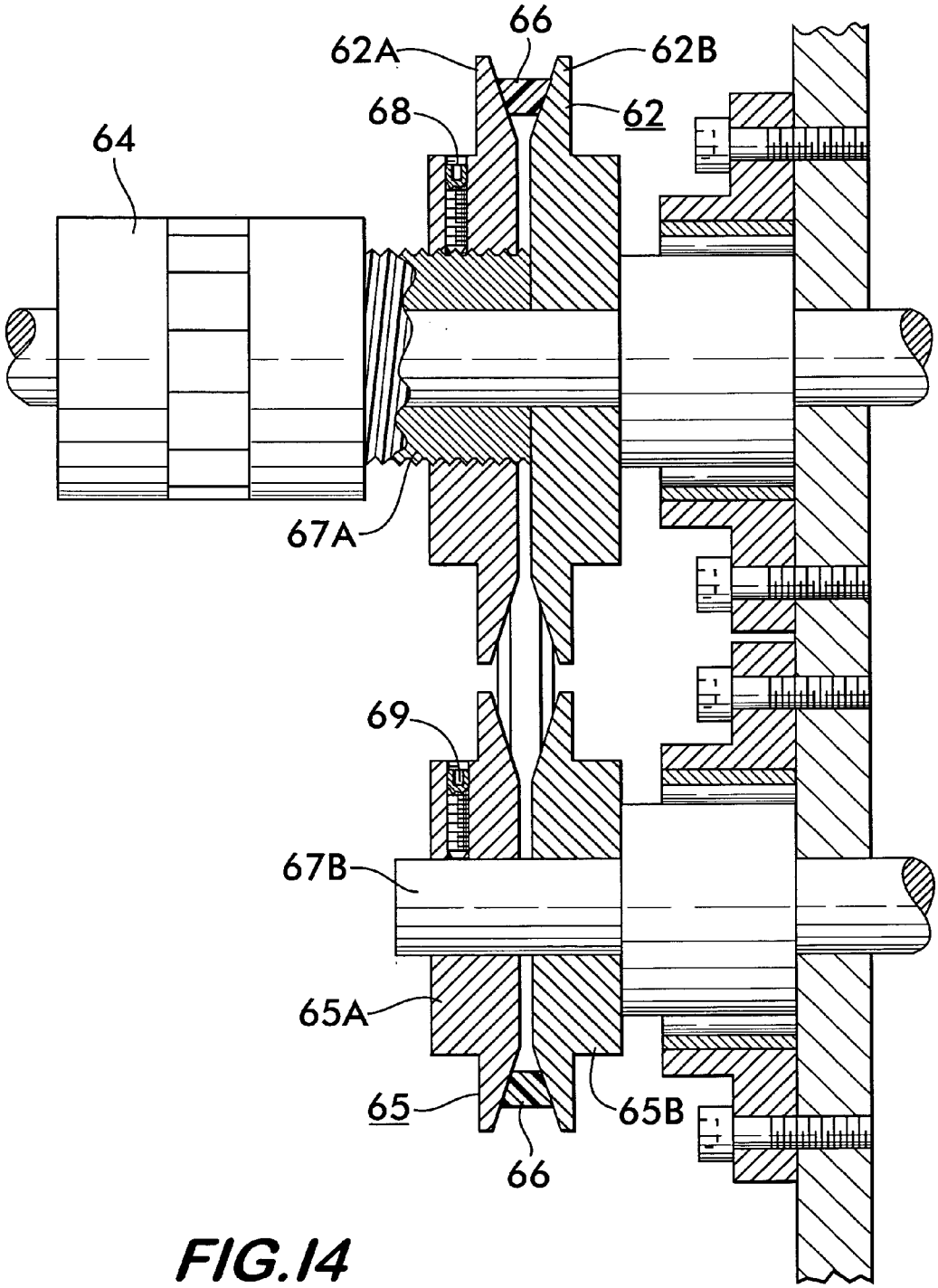
FIG. 14 is a cross sectional detail view of the tape stretch controlling pulleys as would be seen when viewed along the lines 14-14 on FIG. 13.

During packaging, the film 26 is being pulled by the packaging machine 20 and feeds off of its supply roll around guide roller 34, around and between pinch roller 35 and drum 36 where the tape strips 28 are at proper intervals pressed onto the film between the pinch roller 35 and drum 36 overlying the line of perforations cut through the film by the perforator disc 37 when the latter is moved against the film passing over the pinch roller 35 by actuation of air cylinder 38 by air from the Air Supply under the control of solenoid actuated air valve S3. The composite film 24 exiting from between the pinch roller 35 and drum 36 passes around a series of guide rollers 39 and 39A and out of the wrapper former 25 properly positioned over the products on conveyor 22, and on to the packaging machine 20. Consequently, when film is being pulled, roller 35 and drum 36 are continuously rotating and function to time the other events in the cycle. However, as previously noted and as will be subsequently seen, the tape 27 is not being fed constantly, but is fed intermittently, its non-adhesive surface sliding on the rotating surface of drum 36 when not being fed. As best seen in FIGS. 11 and 14, the roller 39A is shiftable toward and away from the rollers 39 by means of a rack and pinion drive 39B to adjust the position of tape strip 28 relative to the package.

The tape 27 from which the perforations sealing tape strips 28 are formed feeds off of its supply roll 27A and passes around an edge turner 40 which turns one marginal side edge portion of the tape upon itself, adhesive face to adhesive face, so that the turned marginal edge is adhered to the main portion of the tape and forms the previously described dry edge 31. The dry edge tape then passes around a guide roller 41, between tape differential stretcher entrance rollers set 42, past tape heater 44, between tape differential stretcher exit rollers set 43, around guide roller 45, around dancer roller 46, and onward to tape pinch roller set 47 and 48, roller 48 being only unidirectionally rotatable.

Figure 13:
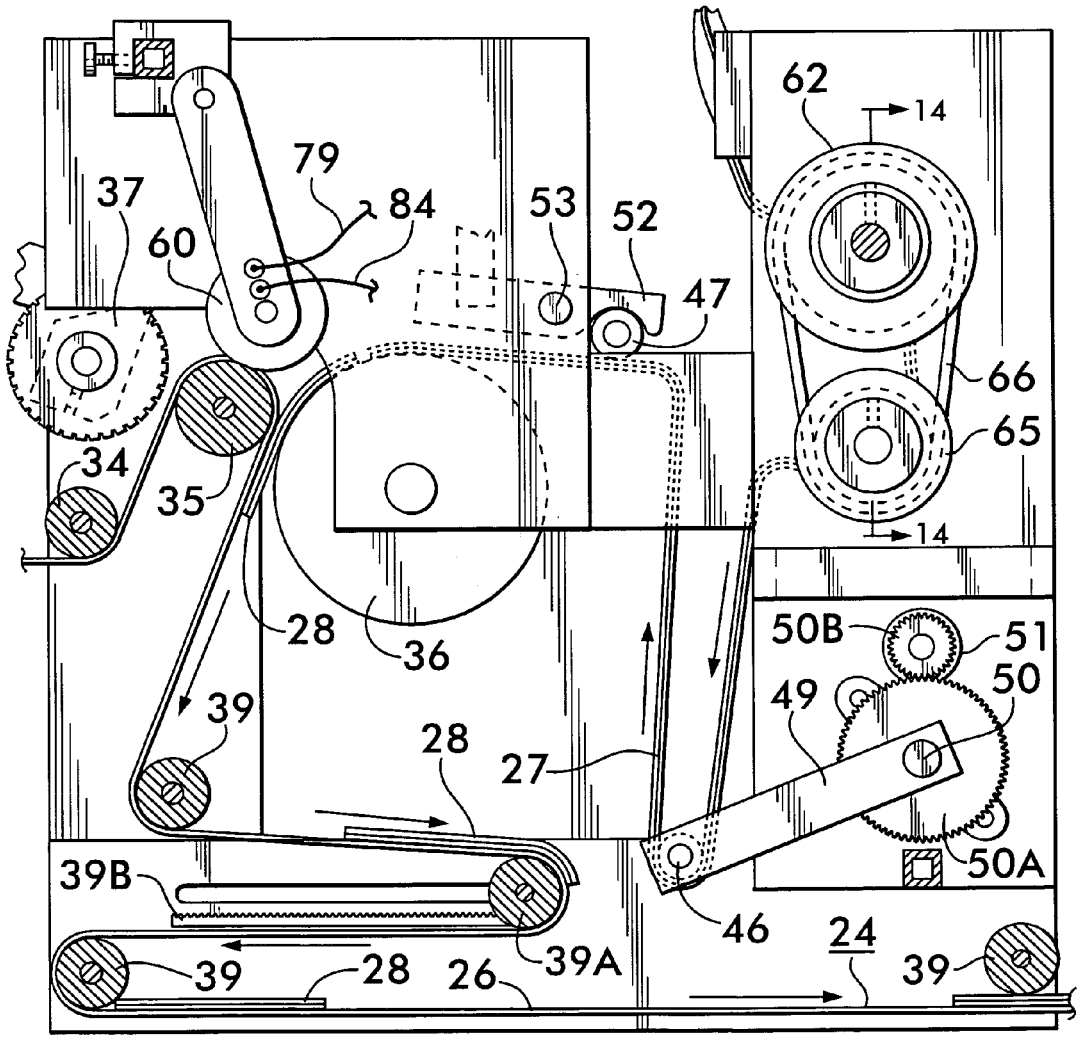
FIG. 13 is a vertical sectional view through the novel apparatus according to the invention as would be seen when viewed along lines 13-13 on FIG. 12.

As best seen in FIGS. 11 and 13, the dancer roller 46 carried on dancer arm 49 is rotatable on a shaft 50 which controls the voltage output of potentiometer 51 through engagement of gears 50A and 50B that in turn controls on and off operation of the motor 61. The motor 61, when turned on, drives split pulley 62 through a speed reducing gear box 63 and pulley drive coupling 64 to drive the stretch rollers set 42. The pulley 62 drives smaller diameter split pulley 65 through the belt 66 to drive the second set of stretch rollers 43 at a faster rate than the rollers 42, the differential rotations of the stretcher rollers sets 42 and 43 producing the stretched tape.

As seen in FIG. 14, the pulleys 62 and 65 are both adjustable diameter pulleys, so that the differential rotation rates of the pulleys may be controlled through a continuous range by relative diameter adjustment between the pulleys to produce different degrees of tape 27 stretch as required. The diameter of pulley 62 is changed by loosening locking screw 68 and rotating pulley half 62A on threaded shaft 67A, and retightening the locking screw 68. Rotating pulley half 62A away from pulley half 62B effectively reduces the pulley diameter to allow belt 66 to ride downward in the pulley vee and reduce the drive ratio to pulley 65. Rotating pulley half 62A toward pulley half 62B has the opposite effect. The effective diameter of pulley 65 is similarly adjusted by loosening locking screw 69, shifting pulley half 65A on shaft 67B, and retightening locking screw 69.

The to-and-fro motion of the dancer roller 46 relative to the tape pinch rollers 47 and 48 controls the rotation of the differential stretcher rollers 42 and 43 to adjust the variable length tape loop extending between rollers 45, 46, and 47/48 needed to synchronize the feeds of the wrapper film 26 and the tape strips 28. The tape pinch roller 47 is spring loaded toward unidirectionally rotatable roller 48 and maintains a constant holding pressure on the tape 27 against roller 48 to prevent it from being back-pulled when the dancer roller 46 rotates away to increase the size of the tape loop.

Figure 11A:
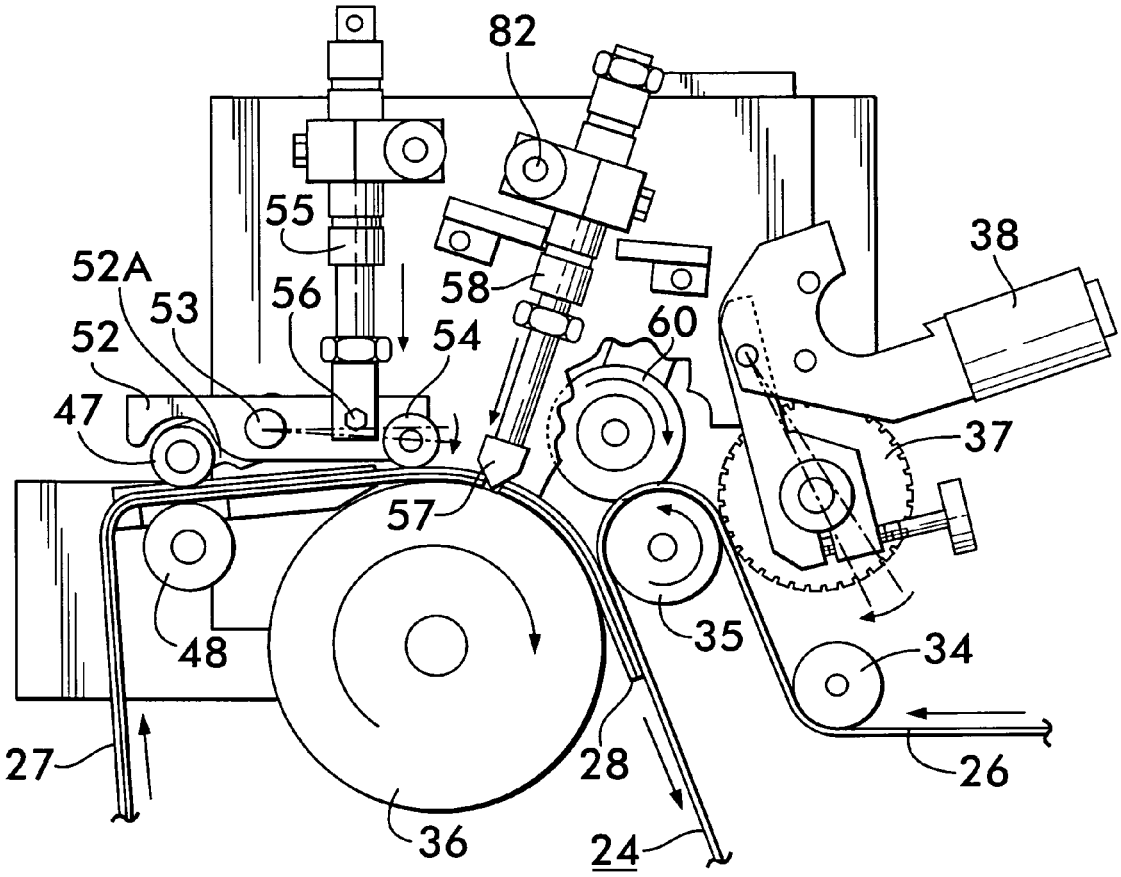
FIGS. 11A and 11B are enlarged portions of the apparatus of FIG. 11 enclosed by the phantom circle on FIG. 11 illustrating sequential stages of the process.
Figure 11B:
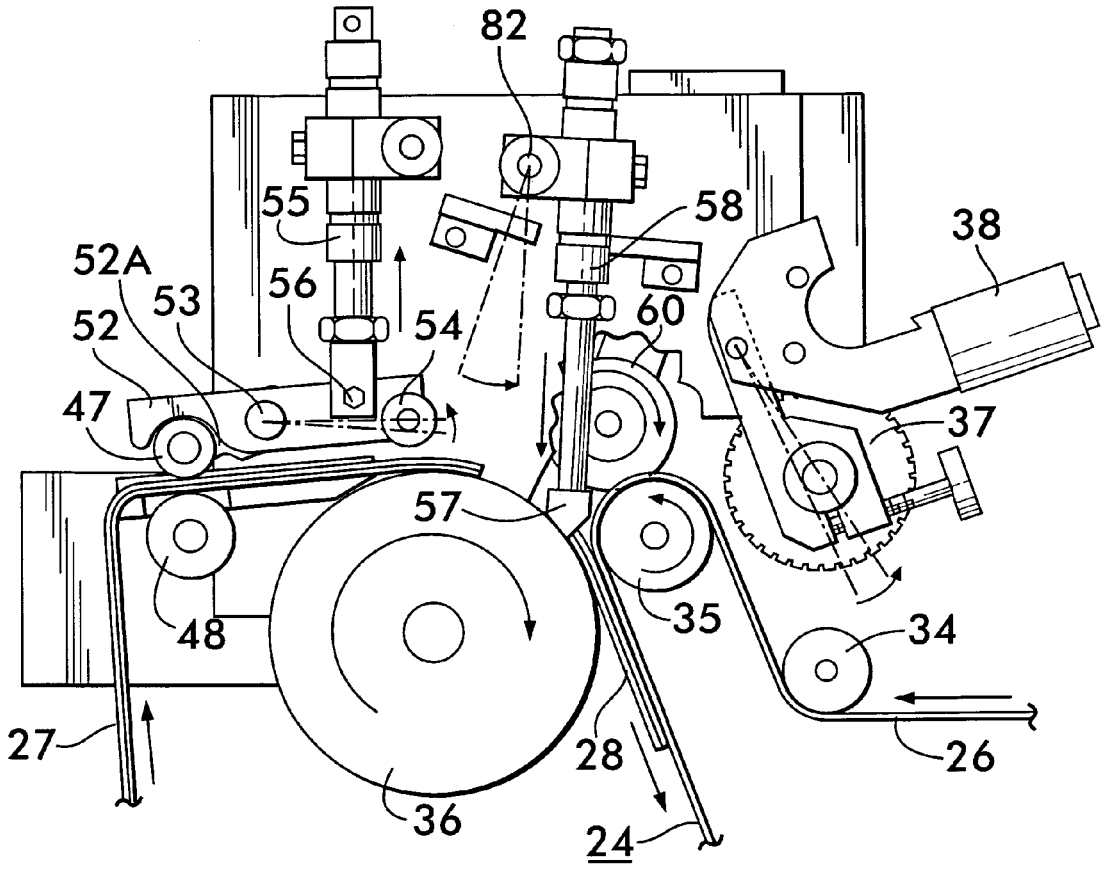

As best seen in FIGS. 11A and 11B, tape pinch roller 47 is mounted on an arm 52A carried on a fixed pivot 53, and arm 52 also carried on fixed pivot 53 carries a tape drive pressure roller 54 controllable to, when required, press the tape 27 against the constantly rotating drum 36 to advance the tape. Movement of the arm 52 about its pivot 53 is controlled by air cylinder 55 to which it is rotatably connected by pivot 56, air cylinder 55 being selectively actuatable by air from the Air Supply under the control of solenoid actuated air valve S1. The means for severing the continuous tape 27 into the tape strips 28 is provided by a hot knife tape cutter 57 carried and selectively actuated by air cylinder 58 by air from the Air Supply under the control of solenoid actuated air valve S2.

Figure 15:
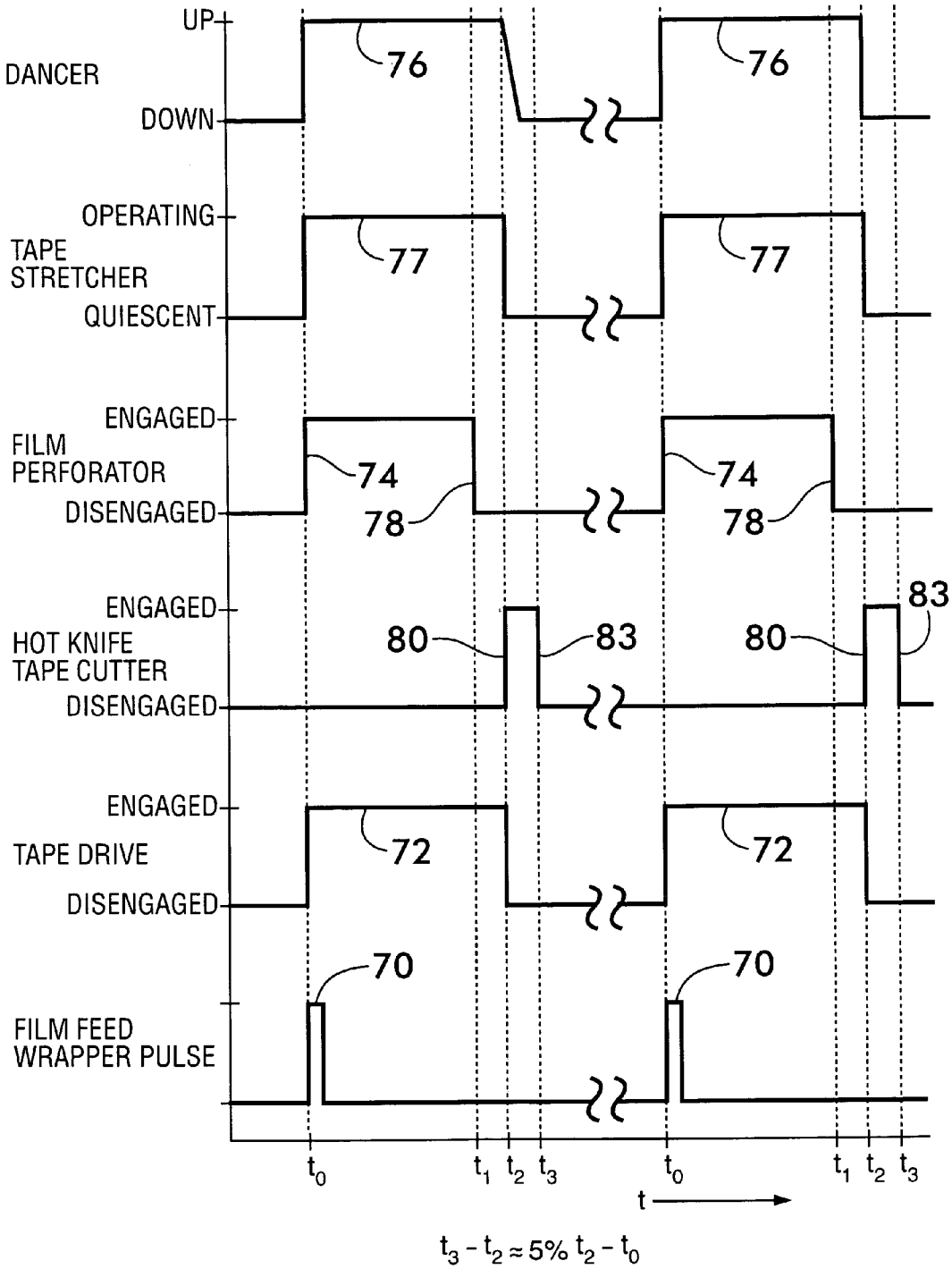
FIG. 15 is timing diagram showing the timing sequence of the apparatus as shown in FIGS. 11 to 14.

The actuation of the solenoid actuated air valves S1, S2 and S3 is controlled by signals generated by Controller 59 in response to signals received on signal input line 71 from the packaging machine 20 and signals received on signal input lines 79 and 84 from Encoder disc 60, driven by the film feed pinch roller 35, as best seen in FIGS. 11 and 13. The timing diagram of FIG. 15 shows the sequence of the initial triggering pulse 70 received from the packaging machine 20 by the Controller 59 on signal line 71 during each cycle of operation, and the timed signals generated by the Controller 59 in response to that signal and those generated by the Encoder 60.

The Controller 59 may suitably be an Allen-Bradley Micro-Logic 1000 and the Encoder 60 may be a Dynapar Model HS 20.

The tape stretching operation to produce the stretched tape disposed in the tape loop controlled by the oscillatory motion of dancer arm 49 is carried out by the differentially rotating stretcher rollers sets 42 and 43, tape drive rollers 43 rotating more rapidly than drive rollers 42, as previously described, thereby stretching the tape between the two sets of rollers. The tape is stretched the amount required to produce a subsequent contraction that matches the shrink characteristics of the packaging film 26, so that in a finished package the tape and film shrink at the same rate to produce a package as shown in FIGS. 3 and 7, and not one as shown in FIG. 9.

Referring now to FIGS. 11, 11A, 11B and 15, the sequence of operation is as follows. The packaging machine 20, at the proper time in each packaging cycle, designated on FIG. 15 as $t_0$, generates a signal 70, which is sent to Controller 59 over signal input line 71. In response to input signal 70, the Controller generates tape drive output signal 72 on signal output line 73, activating solenoid actuated air valve S1 to send air from the Air Supply to air cylinder 55, causing the latter to extend its piston, pivoting arm 52 about pivot 53 to move tape drive pressure roller 54 downward to press the tape 27 against the rotating drum 36 while spring loaded tape pinch roller 47 remains down to continue pressing the tape 27 against unidirectionally rotatable pinch roller 48. Also at the same time, Controller 59 generates film perforator start signal 74 on signal output line 75, actuating solenoid actuated air valve S3 to send air from the Air Supply to air cylinder 38, causing the latter to extend its piston to move perforator disc 37 into engagement with the film 26 and commence perforating the film.

Figure 12:
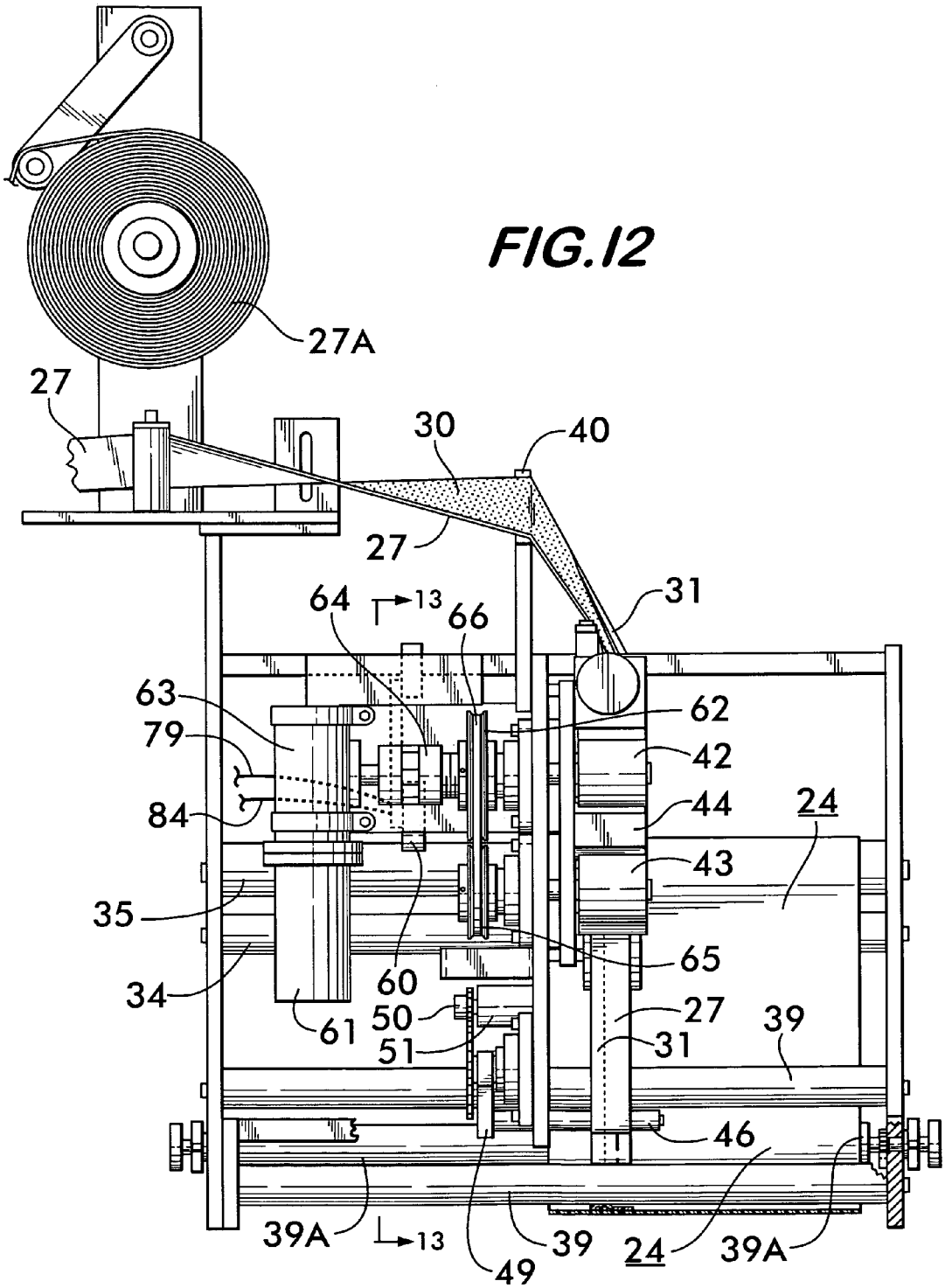
FIG. 12 is an end elevational view of the novel apparatus according to the invention as seen from the side as would be viewed along the lines 12-12 on FIG. 11.

The advance of the tape 27 pivots the dancer arm 49 up to allow tape to be drawn from the dancer tape loop as shown by the dancer position waveform 76, which causes the potentiometer 51 to generate a signal 77 starting motor 61 and activating the tape stretcher drive rollers 42 and 43. As best seen in FIGS. 12 and 13, the Encoder 60 rotates synchronously with the pinch roller 35, and when it has measured the proper length of the perforation row being made by perforator disc 37 it generates a signal 78 to the Controller 59 on line 79, in response to which the Controller terminates the signal 74 on signal line 75, thereby deactivating solenoid air valve S3 and air cylinder 38 and retracting the perforator disc 37 from engagement with the film 26 at time $t_1$.

As best seen in FIGS. 11A and 11B, shortly thereafter, at time $t_2$, the Encoder 60 generates a signal 80 on signal output line 81 actuating solenoid actuated air valve S2 to send air from the Air Supply to air cylinder 58, causing the latter to extend its piston and press hot knife tape cutter 57 down against the tape 27 to cut the tape. However, tape cutting is not instantaneous and the hot cutter 57 remains in contact with the tape for the necessary interval to insure severing, the interval being shown on FIG. 14 as the interval $t_3-t_2$=about 5% $t_2-t_0$, during which interval the cutter 57 rotates about pivot 82 and remains engaged with the tape 27 against drum 36. At the end of the tape cutting interval the Encoder 60 generates a signal 83 on signal line 84 to the Controller 59 which causes the latter to terminate the signal on line 81, thereby deactivating air valve solenoid S2 and deactuating air cylinder 58 and retracting the hot knife tape cutter 57 out of engagement with the tape 27. The timing of Encoder 60 signal 80 at $t_2$ determines the length of the tape strip 28, which is in turn determined by the length of the row of perforations 29.

At the start of tape severing at $t_2$, the Controller 59 terminates the tape drive signal 72 on signal line 73, thereby deactivating air valve solenoid S1 and deactuating air cylinder 55 to raise pressure roller 54 and terminate the tape advance. Because the tape rollers are still feeding tape, the dancer arm 49 moves down rapidly, quickly increasing the tape loop and rotating the potentiometer 51 to rapidly decrease the voltage to the motor driving the stretcher rollers 42 and 43 and terminating their movement. At this point, the cycle is complete, and a new cycle is initiated when the packaging machine generates its next pulse 70, as shown on FIG. 14.

If packaging is to be carried out with non-shrink-wrap film, the perforations sealing tape will also be non-shrink, the tape stretcher rollers sets 42 and 43 would be replaced with only a single set of tape feed rollers, and the tape heater would be turned off. The packaging machine 20 could be a Linium Model 301 horizontal packager made by Sig Doboy Inc. In all other particulars the apparatus and operation would remain the same. Because of the contraction with time of the stretched tape according to the invention, the manufacture for storage and subsequent use of pre-formed rolls of shrink film with applied stretched tape strips is not practical. However, with the use of non-shrink film and non-stretched tape strips, the manufacture for storage and subsequent use of pre-formed rolls of packaging film with pre-applied tape strips is practical.

Having now described our invention, it will be understood that modifications and variations thereof may now naturally occur from time to time to those normally skilled in the art without departing from the essential scope or spirit of the invention, and accordingly it is intended to claim the invention both broadly and specifically as indicated in the appended claims.

The invention claimed is:

1. Apparatus for making a composite packaging material for making easy-open packages, comprising in combination, (a) pulling means for pulling a running length of packaging film, said film having defined rupture characteristics, (b) perforating means for perforating said packaging film with a sequence of spaced apart at least one perforation separated from another at a substantially constant fixed interval between adjacent ones of said sequence along the length of said film, (c) tape forming means for forming a continuously extending dry edge plastic tape from a continuous supply of tape having length and width, an upper face, and a lower adhesive coated face except in the region of said dry edge, said adhesive coating having defined adhesive characteristics with respect to said film, said tape forming means comprising stretching means for stretching said plastic tape to the proper extent to impart contraction characteristics thereto that are the same as the contraction characteristics of said packaging shrink film, (d) tape pieces forming means for forming from said continuous dry edge tape discrete pieces of tape extending lengthwise of and spaced apart along the length of said film, and (e) tape adhering means for adhering successive ones of said discrete pieces of tape to said packaging film in overlying sealing relationship to successive ones of said sequence of at least one perforation, said adhesive coated lower face portion of each of said pieces of tape overlying and being both longer and wider than the extent of said at least one perforation which it overlies.

2. Apparatus as set forth in claim 1 wherein said perforating means comprises, (a) a rotatable perforating disc shiftable into and out of engagement with the packaging film to perforate the film when engaged, (b) disc shifting means effective when actuated to shift said perforating disc into engagement with said packaging film and when deactuated to retract said disc, and (c) perforating disc control means operative to actuate and deactuate said disc shifting means.

3. Apparatus as set forth in claim 1 wherein said tape pieces forming means comprises, (a) tape drive means for advancing said continuously extending dry edge tape to a tape cutting station, (b) tape cutting means effective when actuated to engage said advancing continuously extending dry edge tape and cut off a predetermined length to form one of said discrete tape pieces, and when deactuated to disengage from said continuously extending dry edge tape and said cut off discrete tape piece, and (c) tape drive means and tape cutting means control means operative to actuate and deactuate said tape drive means and said tape cutting means in timed relationship to one another.

4. Apparatus as set forth in claim 1 wherein said perforating means comprises, (a) a rotatable perforating disc shiftable into and out of engagement with the packaging film to perforate the film when engaged, (b) disc shifting means effective when actuated to shift said perforating disc into engagement with said packaging film and when deactuated to retract said disc, and (c) perforating disc control means operative to actuate and deactuate said disc shifting means, and wherein said tape pieces forming means comprises, (1) tape drive means for advancing said continuously extending dry edge tape to a tape cutting station, (2) tape cutting means effective when actuated to engage said advancing continuously extending dry edge tape and cut off a predetermined length to form one of said discrete tape pieces, and when deactuated to disengage from said continuously extending dry edge tape and said cut off discrete tape piece, and (3) tape drive means and tape cutting means control means operative to actuate and deactuate said tape drive means and said tape cutting means in timed relationship to one another, and (4) supervising control means coordinating the operations of all of said perforating disc control means, said tape drive means control means, and said tape cutting means control means.

5. Apparatus as set forth in claim 1, wherein, (a) said packaging film is shrink film and said tape is plastic tape, (b) said tape forming means for forming a continuously extending dry edge tape comprises means for stretching said plastic tape to the proper extent to impart contraction characteristics thereto that are the same as the contraction characteristics of said packaging shrink film, wherein said perforating means comprises, (c) a rotatable perforating disc shiftable into and out of engagement with said packaging film to perforate the film when engaged, (d) disc shifting means effective when actuated to shift said perforating disc into engagement with said packaging film and when deactuated to retract said disc, (e) perforating disc control means operative to actuate and deactuate said disc shifting means, wherein said tape pieces forming means comprises, (f) tape drive means for advancing said continuously extending dry edge tape to a tape cutting station, (g) tape cutting means effective when actuated to engage said advancing continuously extending dry edge tape and cut off a predetermined length to form one of said discrete tape pieces, and when deactuated to disengage from said continuously extending dry edge tape and said cut off discrete tape piece, and (h) tape drive means and tape cutting means control means operative to actuate and deactuated said tape drive means, and further comprising, (i) supervising control means coordinating the operations of all of said perforating disc control means, said tape drive means control means, and said tape cutting means control means in timed relationship to one another.

6. Apparatus as set forth in claim 1 wherein said tape stretching means comprises intermittently simultaneously activated forward and rearward spaced apart sets of tape pinch drive rollers, said forward set of rollers being rotated at higher speed than said rearward set of rollers when said rollers are activated, the activation and deactivation of said pinch drive rollers being controlled by said tape pieces forming means.

7. Apparatus as set forth in claim 1, wherein (a) said packaging film is shrink film and said tape is plastic tape, (b) said tape forming means for forming a continuously extending dry edge tape comprises means for stretching said plastic tape to the proper extent to impart contraction characteristics thereto that are the same as the contraction characteristics of said packaging shrink film, wherein said perforating means comprises, (c) a rotatable perforating disc shiftable into and out of engagement with said packaging film to perforate the film when engaged, (d) disc shifting means effective when actuated to shift said perforating disc into engagement with said packaging film and when deactuated to retract said disc, (e) perforating disc control means operative to actuate and deactuated said disc shifting means, wherein said tape pieces forming means comprises, (f) tape drive means for advancing said continuously extending dry edge tape to a tape cutting station, (g) tape cutting means effective when actuated to engage said advancing continuously extending dry edge tape and cut off a predetermined length to form one of said discrete tape pieces, and when deactuated to disengage from said continuously extending dry edge tape and said cut off discrete tape piece, and (h) tape drive means and tape cutting means control means operative to actuate and deactuate said tape drive means, wherein said tape stretching means comprises, (i) intermittently simultaneously activated forward and rearward spaced apart sets of tape pinch drive rollers, said forward set of rollers being rotated at higher speed than said rearward set of rollers when said rollers are activated, the activation and deactivation of said pinch drive rollers being controlled by said tape pieces forming means, and further comprising, (j) supervising control means coordinating the operations of all of said perforating disc control means, said tape drive means control means, and said tape cutting means control means in timed relationship to one another.

8. A method of making a running length of composite packaging material for making easy-open packages, consisting of the steps of, (a) pulling a running length of packaging shrink film, said shrink film having defined rupture characteristics, (b) perforating said packaging shrink film with a sequence of spaced apart discrete at least one perforation separated from one another at a substantially constant fixed interval between adjacent ones of said sequence along the length of said shrink film, (c) forming a continuously extending dry edge plastic tape from a continuous supply of plastic tape having length and width, an upper face, and a lower adhesive coated face except in the region of said dry edge, said adhesive coating having defined adhesive characteristics with respect to said shrink film, including the step of stretching said plastic tape to the proper extent to impart contraction characteristics thereto that are the same as the contraction characteristics of said packaging shrink film, (d) forming discrete pieces of tape from said continuous dry edge tape extending lengthwise of and spaced along the length of said shrink film, (e) adhering successive ones of said discrete pieces of tape to said packaging shrink film in overlying sealing relationship to successive ones of said sequence of at least one perforation, said adhesive coated lower face portion of each of said pieces of tape overlying and being both longer and wider than the extent of said at least one perforation which it overlies.

9. The method of making a running length of composite packaging material as set forth in claim 8 wherein the step of perforating said packaging film with a sequence of spaced apart discrete at least one perforation consists of the step of moving a shiftable rotatable perforating disc into and out of engagement with the packaging film to perforate the film when engaged.

10. The method of making a running length of composite packaging material as set forth in claim 8 wherein the step of perforating said packaging film with a sequence of spaced apart discrete at least one perforation consists of the step of intermittently moving a shiftable rotatable perforating disc into and out of engagement with the packaging film at fixed intervals to perforate the film at spaced apart fixed lengths of said packaging film.

11. The method of making a running length of composite packaging material as set forth in claim 8 wherein the step of forming discrete pieces of tape from said continuous dry edge tape consists of the steps of, (a) advancing said continuously extending dry edge tape to a tape cutting station, and (b) cutting off a predetermined length of said advancing continuously extending dry edge tape to form one of said discrete tape pieces.

12. The method of making a running length of composite packaging material as set forth in claim 8 wherein the step of forming discrete pieces of tape from said continuous dry edge tape consists of the steps of, (a) intermittently advancing said continuously extending dry edge tape to a tape cutting station, and (b) cutting off successive predetermined lengths of said intermittently advanced continuously extending dry edge tape to form successive ones of said discrete tape pieces.

13. The method of making a running length of composite packaging material as set forth in claim 8 wherein the step of forming discrete pieces of tape from said continuous dry edge tape consists of the steps of, (a) intermittently advancing said continuously extending dry edge tape at predetermined fixed intervals to a tape cutting station, and (b) cutting off successive predetermined lengths of said intermittently advanced continuously extending dry edge tape to form successive ones of said discrete tape pieces.

14. The method of making a running length of composite packaging material as set forth in claim 8 wherein said packaging film in shrink film and said tape is plastic tape, and wherein:

(a) the step of forming a continuously extending dry edge tape includes the step of stretching said plastic tape to the proper extent to impart contraction characteristics thereto that are the same as the contraction characteristics of said packaging shrink film, (b) the step of perforating said packaging film with a sequence of spaced apart discrete at least one perforation consists of the step of intermittently moving a shiftable rotatable perforating disc into and out of engagement with the packaging film at fixed intervals to perforate the film at spaced apart fixed lengths of said packaging film, (c) the step of forming discrete pieces of tape from said continuous dry edge tape consists of the steps of, (1) intermittently advancing said continuously extending dry edge tape at predetermined fixed intervals to a tape cutting station, (2) cutting off successive predetermined lengths of said intermittently advanced continuously extending dry edge tape to form successive ones of said discrete tape pieces.

15. Apparatus for making a composite packaging material for making easy-open packages, comprising in combination, (a) pulling means for pulling a running length of packaging shrink film, said film having defined rupture characteristics, (b) tape forming means for forming a continuously extending dry edge plastic tape from a continuous supply of tape having length and width, an upper face, and a lower adhesive coated face except in the region of said dry edge, said adhesive coating having defined adhesive characteristics with respect to said film, said tape forming means comprising stretching means for stretching said plastic tape to the proper extent to impart contraction characteristics thereto that are the same as the contraction characteristics of said packaging shrink film.

16. A method of making a running length of composite packaging material for making easy-open packages, consisting of the steps of:

(a) pulling a running length of packaging shrink film, said shrink film having defined rupture characteristics, (b) forming a continuously extending dry edge plastic tape from a continuous supply of plastic tape having length and width, an upper face, and a lower adhesive coated face except in the region of said dry edge, said adhesive coating having defined adhesive characteristics with respect to said shrink film, including the step of stretching said plastic tape to the proper extent to impart contraction characteristics thereto that are the same as the contraction characteristics of said packaging shrink film.

* * * * *